US007086821B1

(12) United States Patent
Reicks

(10) Patent No.: US 7,086,821 B1
(45) Date of Patent: Aug. 8, 2006

(54) QUICK ATTACHMENT ARRANGEMENT FOR END LOADER

(75) Inventor: Darel J. Reicks, New Hampton, IA (US)

(73) Assignee: L & R Manufacturing LLC, New Hampton, IA (US)

( * ) Notice: Subject to any disclaimer, the term of this patent is extended or adjusted under 35 U.S.C. 154(b) by 3 days.

(21) Appl. No.: 11/047,090

(22) Filed: Jan. 31, 2005

(51) Int. Cl.
*E02F 9/00* (2006.01)

(52) U.S. Cl. ..... 414/723; 37/468; 403/327

(58) Field of Classification Search ..... 414/723; 37/468; 403/324, 325, 327
See application file for complete search history.

(56) References Cited

U.S. PATENT DOCUMENTS 4,085,856 A * 4/1978 Westendorf ..... 414/723
4,846,624 A 7/1989 Hohn
4,986,722 A 1/1991 Kaczmarczyk et al.
5,224,816 A 7/1993 Kaczmarczyk et al.
5,263,810 A * 11/1993 Takekata et al. ..... 414/723

OTHER PUBLICATIONS

Traction Action by Westendrof, 100 Sereis; Westendorf Mfg. Co, Inc., Ottawa, Iowa, USA.
Buhler Allied Front End Loader; Buhler Manufacturing, Winnipeg, Manitoba, Canada.
The Original MDS Sur-Lock; MDS Manufacturing Co., Inc., Parkston, South Dakota, USA.

* cited by examiner

*Primary Examiner*—Donald Underwood
(74) *Attorney, Agent, or Firm*—Emrich & Dithmar, LLC

(57) ABSTRACT

An attachment device for releasably securing an implement such as a bucket, pallet fork, etc., to the arms of an end loader includes a self-contained latching mechanism. The latching mechanism extends between the arms and has a first upper U-shaped support groove and a lower slot for receiving and engaging respective upper and lower elongated mounting pins of the implement. A linearly movable latch pin, or plunger, is disposed adjacent the lower slot for locking the implement's lower mounting pin in position within the slot in attaching the implement to the end loader. The latch pin also undergoes a pivoting motion during mounting pin insertion and removal to allow for automatic implement attachment to and disconnection from the end loader without the end loader operator having to leave the end loader and manually tend to the attachment device.

42 Claims, 7 Drawing Sheets

QUICK ATTACHMENT ARRANGEMENT FOR END LOADER

FIELD OF THE INVENTION

This invention relates generally to end loaders and attachments therefor, and is particularly directed to a quick attachment arrangement for allowing a first unlatched implement such as a bucket, sweeper, pallet fork, etc., to be removed from an end loader and a second replacement implement to be securely attached to the end loader without requiring the operator to leave the operating position on the end loader and manually tend to the attachment arrangement. This invention also allows an implement to be automatically attached to the end loader without operator manual intervention whether the latching mechanism is in the closed, latched configuration or the open, unlatched configuration.

BACKGROUND OF THE INVENTION

End loaders are commonly used for performing various industrial and agricultural tasks. The typical end loader is comprised of a vehicle, such as a tractor, having a pair of flexible arms typically extending from the front end of the vehicle, where the arms can be raised and lowered for performing work. Various types of implements may be attached to the ends of the arms for performing such tasks as lifting, sweeping, digging, grading, etc. Thus, the implement attached to the end loader may take the form of a scoop or a fork structure for lifting and transporting an object or loose material such as dirt or stone, a sweeper for cleaning a surface, or a grader for working the ground. In virtually all cases, the load bearing or load moving implement is of high strength and is typically comprised of a strong metal such as steel and is thus of considerable weight.

Because the various implements discussed above are designed to perform a specific task, it is necessary to change implements when the performance of various tasks is required. It is thus highly desirable to facilitate and simplify the removal of one implement from and the attachment of another implement to the end loader's movable arms. Unfortunately, there is a great variety of lift arm attachment arrangements, where the specific design of the attachment arrangement is determined by the individual implement or end loader manufacturer. Some end loader attachment arrangements make use of a pair of vertically spaced, horizontally aligned mounting pins which are adapted for engagement by upper and lower pairs of grooves, or slots, on the ends of the end loader arms. Another attachment scheme makes use of left and right brackets, each adapted to receive a generally vertically oriented connecting pin for attaching the implement to the ends of the end loader's two lift arms. The various attachment arrangements incorporate different connecting hardware and employ different installation and removal procedures in attaching and releasing the implement from the end loader and are thus incompatible.

A typical attachment device used for attaching an implement to a pair of end loader arms typically has a first side adapted for connection to the ends of the end loader arms and a second, opposed side for connecting to the implement. In some cases, part of the attachment arrangement is incorporated in the attachment device, while another part of the attachment arrangement is mounted integrally with the implement. For example, U.S. Pat. No. 4,986,722 discloses an implement attachment arrangement having a first locking pin 106 disposed on one end of a bucket 50 which is adapted for engaging an attachment carrier 30 mounted to an end of the end loader's moveable arm 22. Also attached to the movable arm 22 is an actuator mechanism having contact pin 122 which engages a handle 118 of locking pin 106 for moving the pin to a locking position as the attachment is rocked about a pivotal axis by an attachment cylinder. This complicated arrangement requires mutually engaging components of the latching mechanism on the implement as well as on the end loader. Preferably, the entire latching mechanism would be located on either the implement or the end loader to simplify its design and eliminate the requirement for precise alignment of the implement and loader arms for attaching/detaching the implement.

The latching mechanism also typically requires manual intervention by the end loader operator in releasing an implement from or attaching an implement to the end loader's arms. More specifically, the end loader operator must set the latch mechanism to a release configuration for disconnection of the implement from the end loader or set the latch mechanism to an engagement configuration for attaching the implement to the end loader. This requires the end loader operator to leave the operating position on the end loader twice in changing the implement attached to the end loader, once to disconnect the implement to be released and a second time to connect a replacement implement. This procedure is inefficient and subjects the operator to possible injury during implement release from or attachment to the end loader's arms. In addition, the operator's manual intervention in the attachment procedure raises the possibility of subsequent implement detachment due to human error.

The present invention addresses the aforementioned limitations of the prior art by providing an attachment arrangement for mounting an implement to the arms of an end loader which is self-contained on the end loader arms and requires only a pair of fixed, spaced, parallel mounting pins on the implement. This inventive quick attachment arrangement allows an implement to be attached to the end loader's arms regardless of the configuration of the latching mechanism, and the implement may be removed and replaced with another implement attached to the arms without requiring the end loader operator to leave the operating position for the purpose of manually manipulating the latching mechanism.

OBJECTS AND SUMMARY OF THE INVENTION

Accordingly, it is an object of the present invention to provide an improved arrangement for connecting an implement to the arms of an end loader which is reliable, self-contained on the ends of the end loader arms, and does not require the end loader operator to leave the operator's seat to change implements.

It is another object of the present invention to provide a latching mechanism for removably mounting an implement to the ends of a pair of end loader arms which does not require manual intervention by the end loader operator.

Yet another object of the present invention is to provide a quick attachment device for attaching an implement to an end loader which is self-contained and includes no moving parts on either the implement or the arms of the end loader.

A further object of the present invention is to provide a connection arrangement for an implement on the end of a pair of boom arms such as on an end loader which employs a pair of latching pins which undergo linear displacement along their respective lengths as well as pivoting displacement in latching the implement to, as well as unlatching the implement from, the boom arms.

This invention contemplates apparatus for attaching an implement having upper and lower mounting pins to a movable arm of an end loader, the apparatus comprising: a bracket pivotally coupled to the movable arm; an upper support member on the bracket adapted to engage and retain the upper mounting pin of the implement; a lower slot in the bracket adapted to receive the lower mounting pin of the implement; first and second apertured members disposed on the bracket; a latch pin disposed in the apertures of the first and second apertured members and movable between a first unlatched position, wherein the latch pin is substantially clear of the lower slot and the lower mounting pin may be removed from the lower slot, and a second latched position, wherein the latch pin is disposed across the lower slot and the lower mounting pin is connected to the bracket for attaching the implement to the end loader arm; a biasing member coupled to the latch pin for urging the latch pin to the second latched position; and a catch portion of the latch pin for engaging the first apertured member and maintaining the latch pin in the first unlatched position to allow the lower mounting pin to be removed from the lower slot as the lower mounting pin engages and pivotally displaces the latch pin in a first direction for maintaining the latch pin's catch portion in engagement with the first apertured member, and wherein a second lower mounting pin attached to a second implement inserted in the lower slot engages and pivotally displaces the latch pin in a second opposed direction for removing the latch pin's catch portion from engagement with the first apertured member and allowing the latch pin to move to the second latched position by means of the biasing member in attaching the second implement to the end loader.

This invention further contemplates apparatus for attaching an implement having upper and lower mounting pins to a movable arm of a vehicle, the apparatus comprising: a bracket pivotally coupled to the movable arm; upper and lower slots in the bracket respectively adapted to engage and retain the upper and lower mounting pins; first and second apertured members disposed on the bracket; a latch pin having an angled distal end portion and disposed in the apertures of the first and second apertured members and movable between a first unlatched position, wherein the latch pin is clear of the lower slot allowing the lower mounting pin to be removed from the lower slot, and a second latched position, wherein the latch pin is disposed across the lower slot and the lower mounting pin is connected to the bracket for attaching the implement to the end loader arm; a biasing member coupled to the latch pin for urging the latch pin to the second latched position; and a catch portion of the latch pin for engaging the first apertured member and maintaining the latch pin in the first unlatched position to allow the lower mounting pin to be inserted in and removed from the lower slot, wherein the lower mounting pin engages the end of the latch pin when inserted in the lower slot with the latch pin in the first unlatched position for pivotally displacing the latch pin and removing the latch pin's catch portion from engagement with the first apertured member and allowing the latch pin to move to the second latched position under the influence of the biasing member for attaching the implement to the end loader, and wherein the lower mounting pin engages the angled distal end portion of the latch pin when inserted in the lower slot and the latch pin is in the second latched position for urging the latch pin to the first unlatched position and allowing the lower mounting pin to be inserted in the lower slot whereupon the lower mounting pin pivotally displaces the latch pin so as to disengage the latch pin's catch portion from the first aperture member allowing the latch pin to assume the second latched position in attaching the implement to the end loader.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
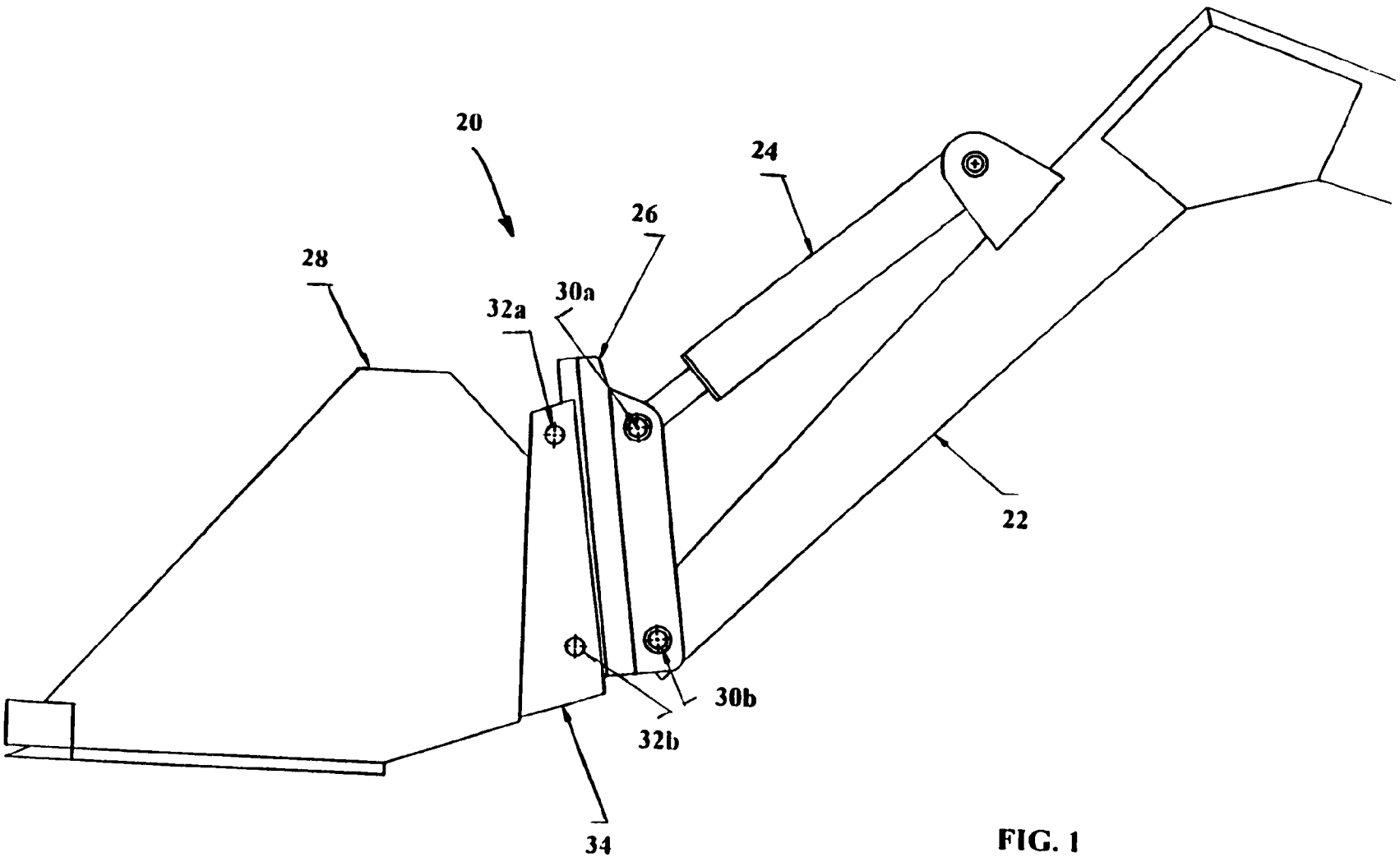
FIG. 1 is a side elevation view showing a bucket implement attached to an arm such as of an end loader by means of an attachment device in accordance with the principles of the present invention.
Figure 5:
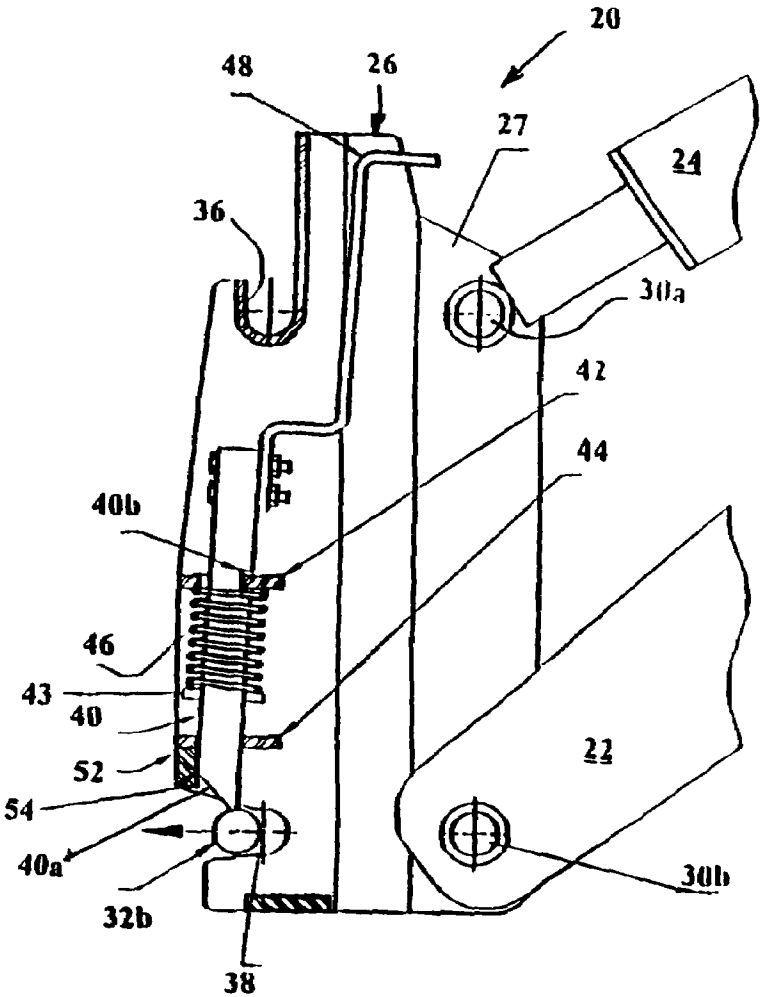
FIGS. 2–5 are vertical sectional views of the attachment device of the present invention illustrating the position of various components of the attachment device during insertion in and removal from the attachment device of an implement mounting pin, and further illustrating the attachment device in the unlatched and latched configurations.

Referring to FIG. 1, there is shown a side elevation view of an implement such as a bucket 28 connected to a loader arm 22 such as of an end loader by means of a quick attachment arrangement 20 in accordance with the principles of the present invention. Attached to an aft portion of the bucket 28 is a mounting bracket 34. Attached to the loader arm 22 is a hydraulic cylinder 24 for raising and lowering the loader arm as well as the bucket 28 attached thereto. The attachment device 26 of the present invention is attached to the hydraulic cylinder 24 and the loader arm 22 by means of respective first upper and lower mounting pins 30*a* and 30*b*. A second, opposed portion of the attachment device 26 is connected to the bucket mounting bracket 34 by means of second upper and lower mounting pins 32*a* and 32*b*.

Figure 8:
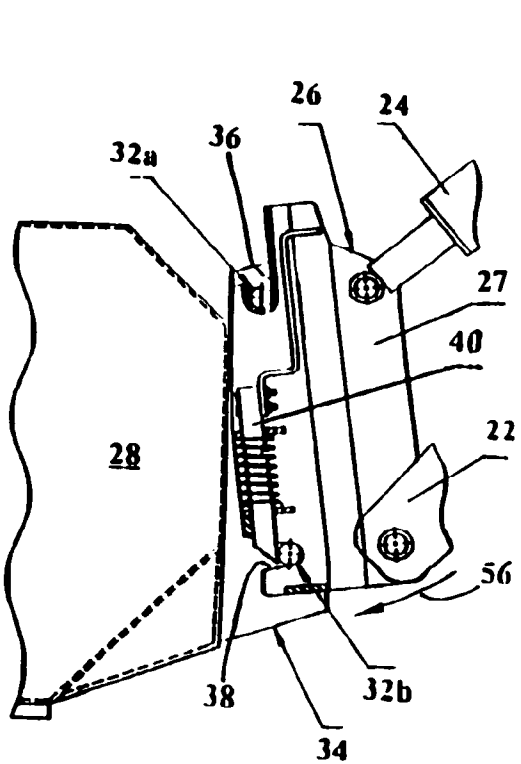
FIGS. 6, 7 and 8 are vertical sectional views illustrating the series of steps involved in attaching an implement to the attachment device of the present invention with the attachment device's latching pin, or plunger, in the up, unlatched position.
Figure 7:
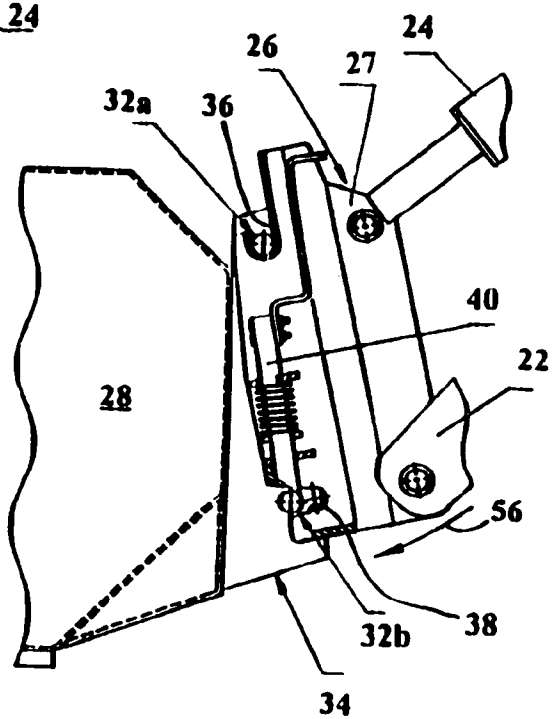
Figure 6:
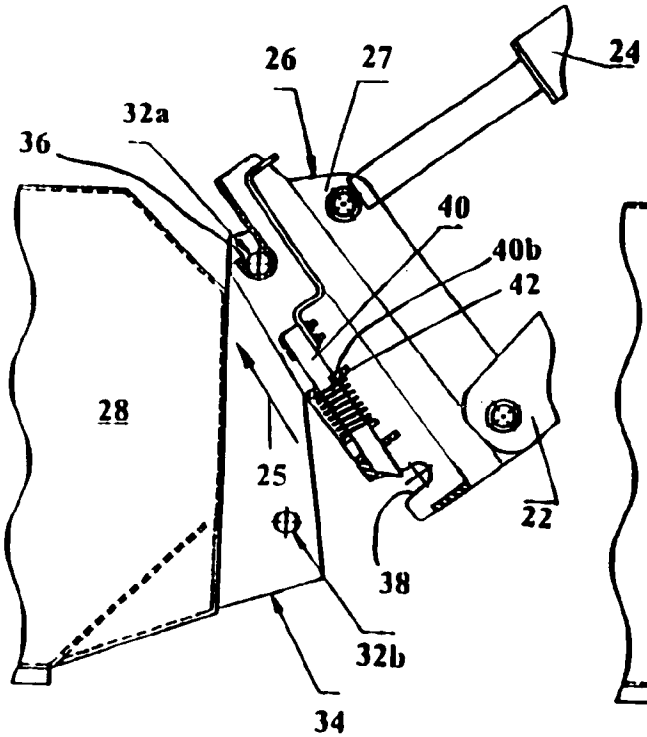
Figure 11:
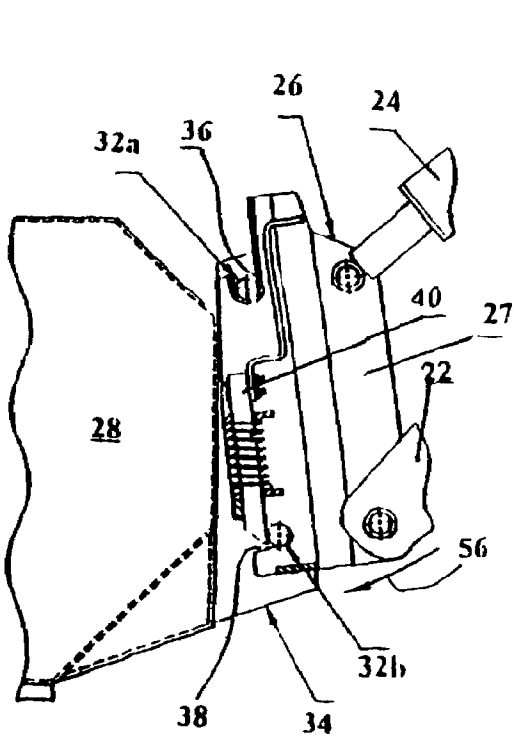
FIGS. 9, 10 and 11 are vertical sectional views illustrating the series of steps involved in attaching an implement to the attachment device of the present invention with the attachment device's latching pin the down, latched position.
Figure 10:
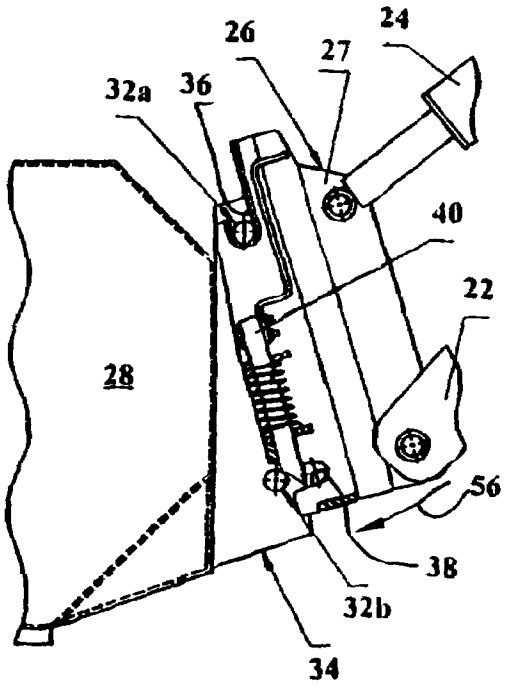
Figure 9:
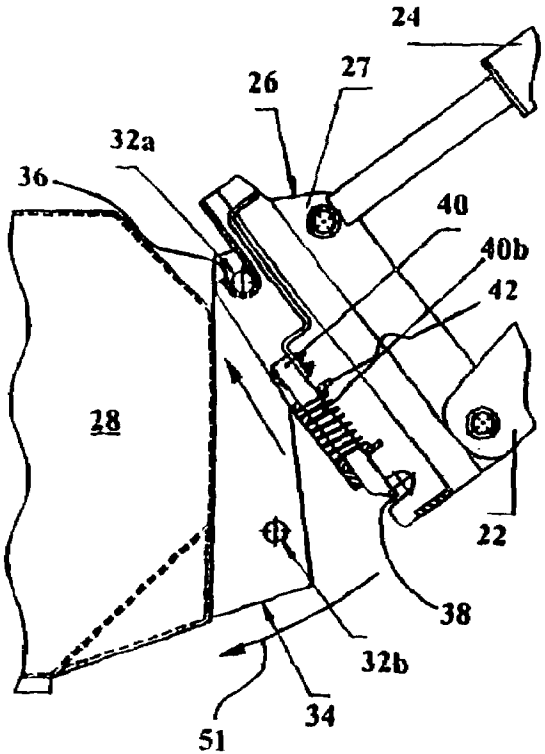
Figures 12, 13, 14:
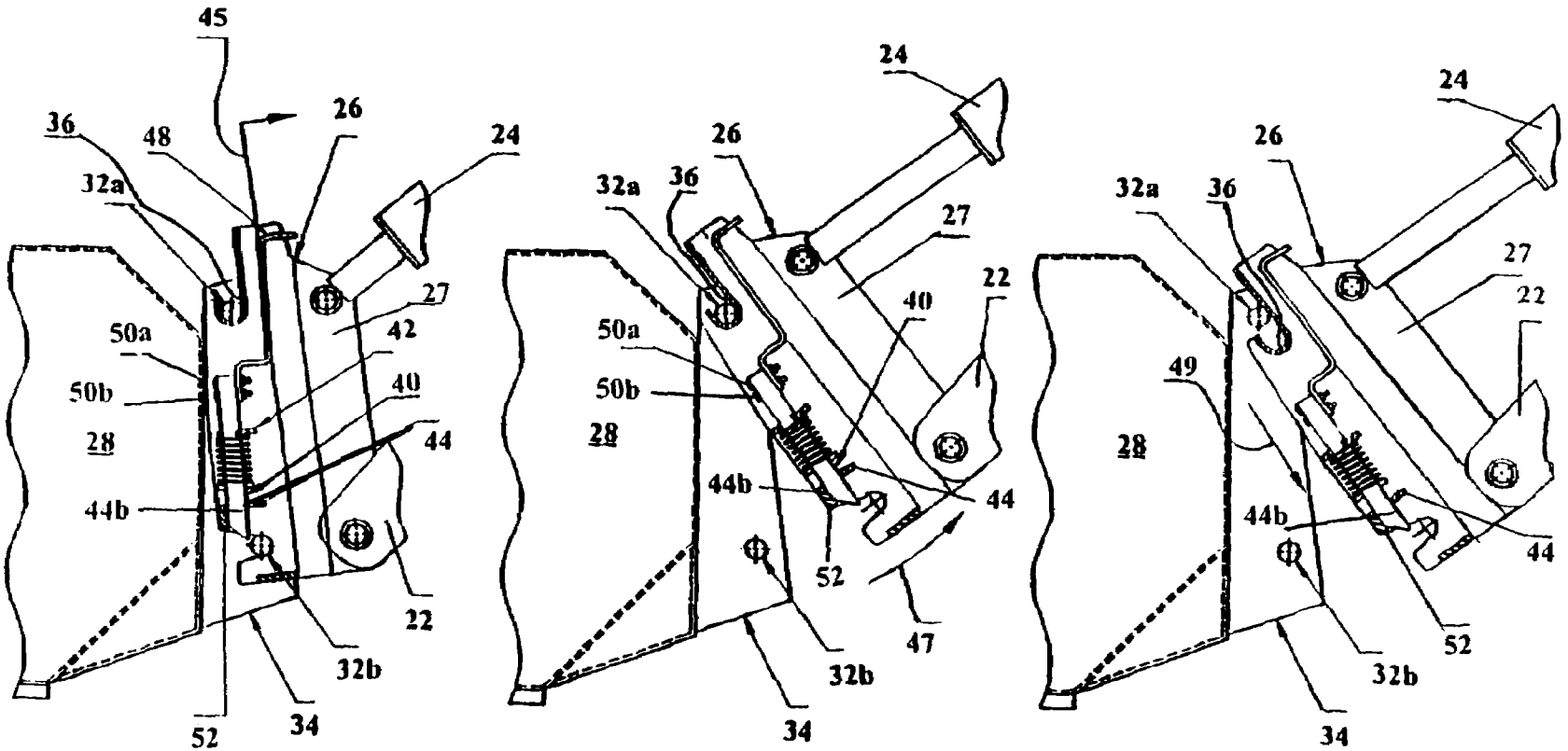
FIGS. 12, 13 and 14 are vertical sectional views illustrating the series of steps involved in detaching an implement from the attachment device of the present invention.

Referring to FIGS. 2–5, there are shown vertical sectional views of a quick attachment arrangement 20 including an attachment device 26 in accordance with the present invention illustrating the attachment device configuration when being attached to, and when removed from, a mounting pin of an implement. Referring to FIGS. 6, 7 and 8, there are shown vertical sectional views of the quick attachment arrangement 20 of the present invention illustrating the series of steps involved in engagement of the attachment device 26 with a bucket 28 with the latch pin, or plunger, 40 in the up, or retracted, position. Referring to FIGS. 9, 10 and 11, there are shown vertical sectional views of the quick attachment arrangement 20 of the present invention illustrating the series of steps involved in engagement of the attachment device 26 with bucket 28 with latch pin 40 in the down, or extended, position. Referring to FIGS. 12, 13 and 14, there are shown vertical sectional views of the quick attachment arrangement 20 of the present invention illustrating the disengagement sequence of attachment device 26 from bucket 28. The configuration and operation of the quick attachment arrangement 20 shown in these figures will now be described in detail.

The attachment device 26 of the quick attachment arrangement 20 of the present invention includes a plate 27 which is pivotally connected to and through which extend first upper and lower mounting pins 30*a* and 30*b*. The attachment device 26 may also include a second plate (not shown) in spaced relation from plate 27, with the first upper and lower mounting pins 30*a*, 30*b* connected to and extending between the two spaced, generally parallel plates. Each of the first upper and lower mounting pins 30*a*, 30*b* is connected to an aft portion of the attachment device's plate 27. A forward portion of the attachment device 26 includes an upper U-shaped support groove, or surface, 36 and a lower slot 38, each of which is integrally formed with the attachment device's plate 27. Attachment device 26 further includes an upper catch plate 42 and a lower guide plate 44 mounted to the attachment device's plate 27. Catch plate 42 and guide plate 44 are in vertical alignment and each includes a respective aperture within which is positioned an elongated latch pin, or plunger, 40. Also attached to the attachment device's plate 27 is a face plate 52 which is in contact with the lower guide pin 44 and engages a lower end portion of latch pin 40. Latch pin 40 includes a notch 40*b* in the surface thereof and an angled end portion 40*a* on the lower end thereof. The latch pin's notch 40*b* is adapted to engage an inner edge portion of the upper catch plate 42 where the catch plate's inner edge defines the aperture through which the latch pin extends. The latch pin's angled end portion 40*a* is adapted to engage a bottom mounting pin 32*b* when attaching the attachment device 26 to an implement as described in detail below.

As shown in FIG. 6, attachment device 26 is initially maneuvered so as to position the upper mounting pin 32*a* of the bucket 28 within the upper U-shaped support groove 36 located within an upper portion of the attachment device's plate 27. This is accomplished by orienting the attachment device 26 at an inclined angle and raising the attachment device in the direction of arrow 25 shown in FIG. 6. The lower portion of the attachment device 26 is then moved toward the bucket 28 in the direction of arrow 56 shown in FIGS. 7 and 8 so as to position the bucket's second lower mounting pin 32*b* within the attachment device's lower slot 38 as shown in FIG. 8. Latch pin 40 is shown in FIGS. 6 and 7 in the raised position to allow the bucket's second lower mounting pin 32*b* to be inserted in the attachment device's lower slot 38. However, the attachment device 26 is also adapted to receive the bucket's second lower mounting pin 32*b* within its lower slot 38 with latch pin 40 in the lowered position as described in detail below.

As shown in the various figures, a coil spring 46 is disposed about and attached to latch pin 40. Coil spring 46 engages and is disposed between the upper catch plate 42 and a roll pin 43 inserted through latch pin 40. Coil spring 46 urges latch pin 40 downward to the latched position wherein the lower end of the latch pin extends across lower slot 38 in plate 27. As stated above, notch 40*b* in latch pin 40 is adapted to engage an inner surface of upper catch plate 42. In this manner, latch pin 40 may be securely maintained in a retracted, upraised position even while being urged in a downward direction by coil spring 46. In the upraised position, latch pin 40 does not extend across lower slot 38 within the attachment device's plate 27. When in the upraised, retracted position as shown in FIGS. 6 and 7, only the lower end of latch pin 40 extends into an upper portion of the attachment device's slot 38. Latch pin 40 may be moved to the full down, extended position by expansion of coil spring 46 by laterally displacing the latch pin so that its catch notch 40*b* is no longer in engagement with the upper catch plate 42. Latch pin 40 may be laterally displaced so as to no longer engage catch plate 42 by engagement of the lower end of the latch pin by the bucket's second lower mounting pin 32*b* during automatic operation of quick attachment arrangement 20 as described in the following paragraph.

Figure 2:
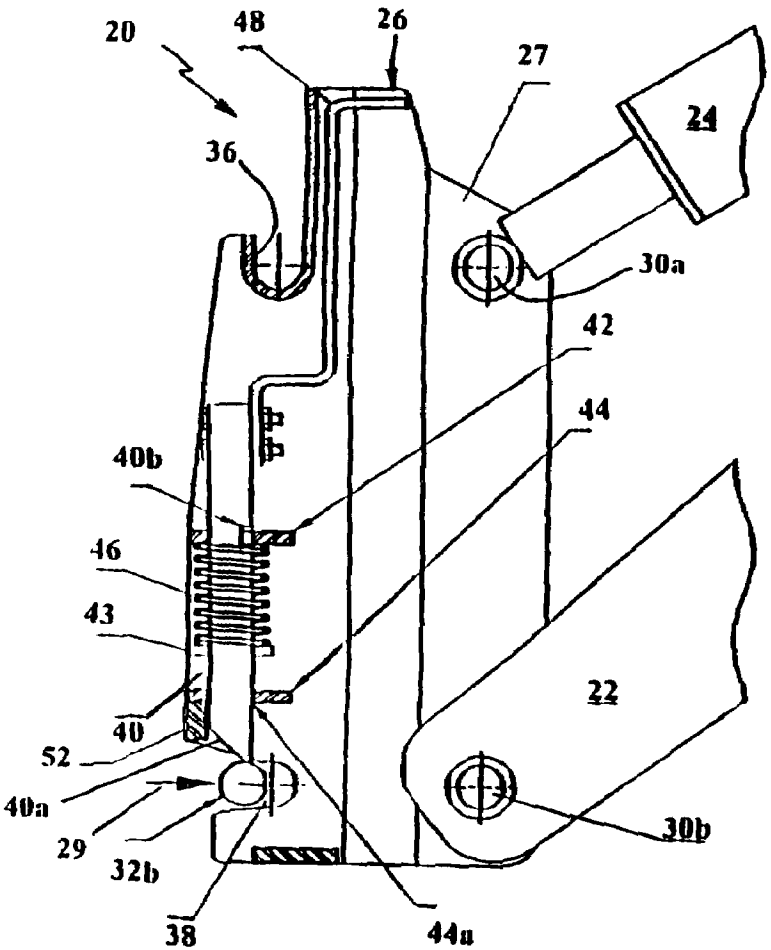
Figure 3:
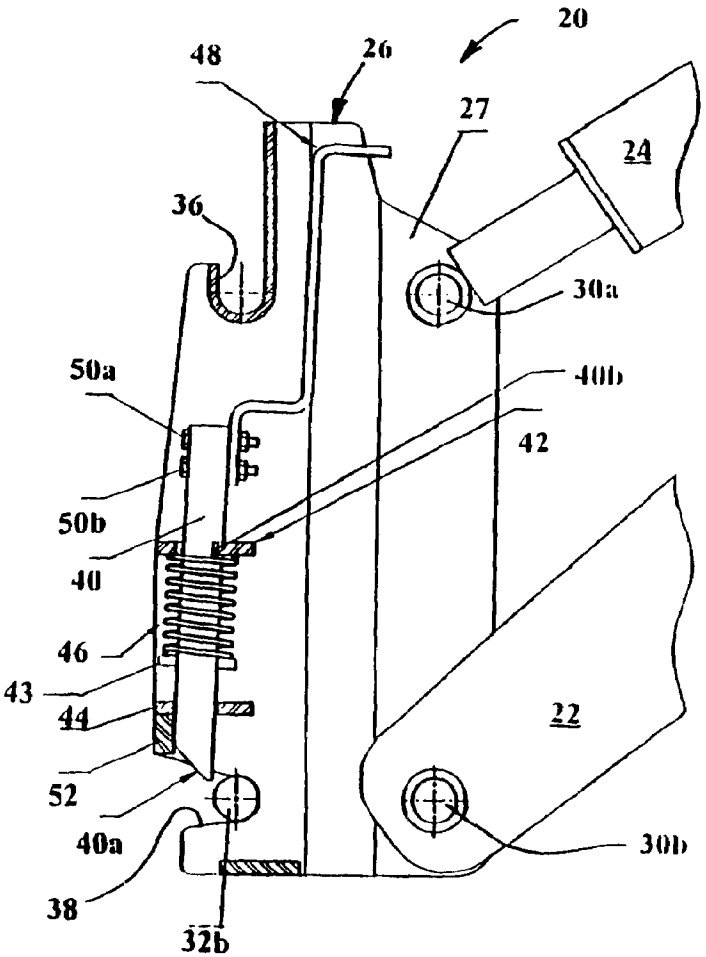
Figure 4:
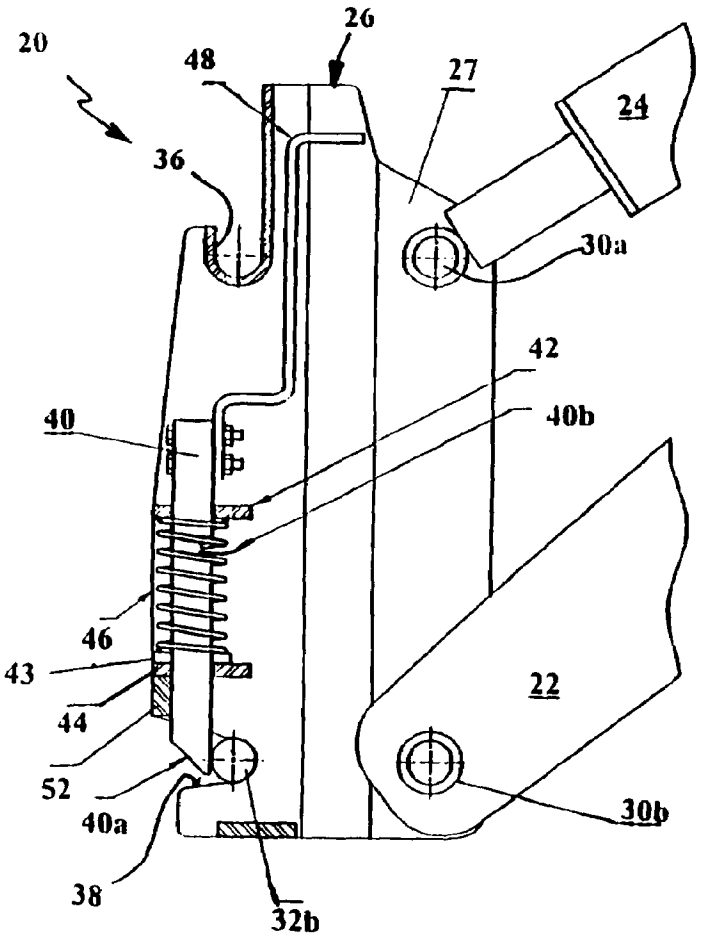

In accordance with automatic operation of the quick disconnect arrangement 20 of the present invention, the bucket's second lower mounting pin 32*b* is moved in the direction of arrow 29 in FIG. 2 and into the attachment device's lower slot 38. When this occurs, the second lower mounting pin 32*b* engages the lower end of latch pin 40 forcing a lower portion of the latch pin into engagement with a pivot point 44*a* on an inner surface of the lower guide plate 44 defining the aperture therein. With the lower end of pivot pin 40 displaced in the direction of arrow 29 in FIG. 2, the upper portion of the pivot pin is pivotally displaced about the pivot point 44*a* in a second direction opposed to that of arrow 29. It is in this manner that the catch notch 40*b* of pivot pin 40 becomes disengaged from catch plate 42 as shown in FIG. 2, allowing coil spring 46 to urge pivot pin 40 downward across the lower slot 38 within the attachment device 26 as shown in FIG. 4. It is in this manner that the attachment device 26 is automatically connected to an implement such as bucket 28 with latch pin 40 initially in the unlatched position without requiring manual intervention by the end loader operator or anyone else. This sequence of automatic operation of the attachment device 26 is also shown in FIGS. 6, 7 and 8.

Bucket 28 may also be automatically connected to attachment device 26 with latch pin 40 initially in the full down position as shown in FIGS. 9, 10 and 11. In this configuration, latch pin 40 is in the full down position prior to connecting bucket 28 to attachment device 26 as shown in FIG. 9. As the lower portion of the attachment device 26 is displaced in the direction of arrow 51 in FIG. 9 toward bucket 28 with the bucket's second upper mounting pin 32*a* disposed within the attachment device's upper U-shaped support groove 36, the bucket's second lower mounting pin 32*b* engages the latch pin's angled lower end portion 40*a* as shown in FIG. 10. Continued displacement of the second lower mounting pin 32*b* into lower slot 38 causes upward displacement of latch pin 40. In addition, the force exerted on the lower end of latch pin 40 by the second lower mounting pin 32*b* causes pivoting displacement of the latch pin about pivot point 44*a* on lower guide plate 44. This causes the lower end of latch pin 40 to move in a direction opposite to that of arrow 51 in FIG. 9 and the upper portion of the latch pin to move in the direction of this arrow. This causes the latch pin's catch notch 40*b* to be displaced away from the inner portion of catch plate 42 defining the aperture therein so that the latch pin is freely slidable within the upper catch plate 42. This allows latch pin 40 to be displaced downward under the influence of coil spring 46 and to assume the full down position after insertion of the second lower mounting pin 32*b* within lower slot 38 as shown in FIG. 11. It is in this manner that latch pin 40 assumes the latched configuration even when the latch pin is in the fully extended, or down, position prior to insertion of the second lower mounting pin 32*b* in lower slot 38.

Referring to FIGS. 12, 13 and 14, there is shown the disengagement sequence for disconnecting bucket 28 from attachment device 26. In FIG. 12, latch pin 40 is shown in the full up, unlatched position. This is achieved by manually engaging handle 48 connected to latch pin 40 by nut and bolt combinations 50*a*, 50*b* and moving the handle in the direction of arrow 45 in FIG. 12. Thus, handle 48 and latch pin 40 are displaced upward and to the right as shown in FIG. 12 causing the latch pin's catch notch 40*b* to engage the inner surface of catch plate 42 so as to maintain latch pin in the upraised, unlatched position shown in FIG. 12. The lower portion of attachment device 26 is then displaced in the direction of arrow 47 by moving end loader arm 22 in a rightward direction as shown in FIG. 13. This causes the bucket's second lower mounting pin 32*b* to be removed from the attachment device's lower slot 38 as shown in FIGS. 12 and 13. As the bucket's second lower mounting pin 32*b* is removed from the attachment device's lower slot 38, the second lower mounting pin engages the lower end of latch pin 40 causing the latch pin to pivot about pivot point 44*b* in the lower guide plate 44. Latch pin 40 may also partially engage a face plate 52 attached to plate 27 and pivot about a point of contact between the latch pin and the face plate. This urges the upper end of latch pin 40 in the direction of arrow 47 in FIG. 13 so as to maintain the latch pin's catch notch 40*b* in engagement with the catch plate 42 to maintain the latch pin in the fully upraised, unlatched position shown in FIG. 13. While lower guide plate 44 and face plate 52 are shown as separate elements in the various figures, they may equally as well be in the form of a single piece of hard, high strength metal such as steel which is the preferred composition of the entire inventive quick attachment arrangement. The attachment device 26 is then lowered in the direction of arrow 49 shown in FIG. 14 by end loader arm 22 to disconnect bucket 28 from the attachment device 26. With latch pin 40 in the fully upraised, unlatched position, the attachment device 26 is then ready for connection to another implement without requiring manual intervention or reconfiguration of the quick attachment arrangement of the present invention.

Figure 15:
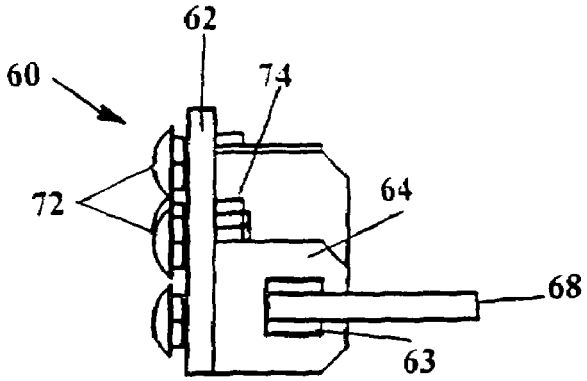
FIGS. 15, 16 and 17 are respectively top plan, front elevation and side elevation views of a second embodiment of a quick attachment arrangement in accordance with the principles of the present invention.
Figure 16:
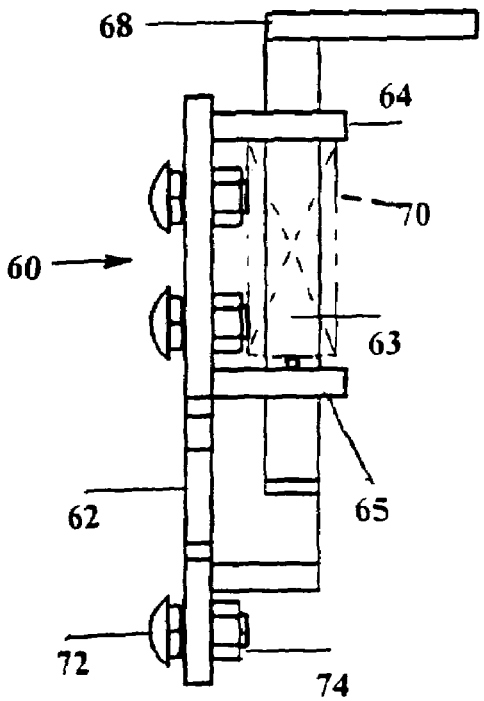
Figure 17:
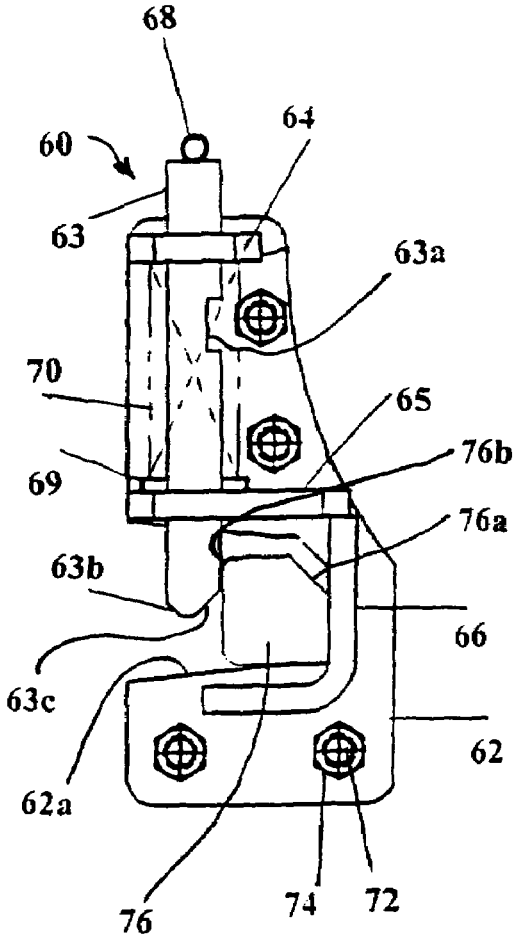

Referring to FIGS. 15, 16 and 17, there are respectively shown top plan, front elevation and side elevation views of a quick attachment arrangement 60 in accordance with another embodiment of the present invention. Quick attachment arrangement 60 includes a mounting bracket 62 to which are attached a top guide plate 64 and a bottom guide plate 65. Mounting bracket 62 is adapted for attachment to an arm of an end loader (not shown for simplicity) by means of plural bolt 72 and nut 74 combinations. Each of the top and bottom guide plates 64, 65 includes a respective aperture, with the apertures in each of these guide plates in vertical alignment. Disposed within the vertically aligned apertures of the top and bottom guide plates 64,65 is a movable latch pin, or plunger, 63. Inserted through latch pin 63 is a roll pin 69. Disposed about latch pin 63 and between the top guide plate 64 and roll pin 69 is a coil spring 70 which is shown in simplified dotted line form in FIGS. 16 and 17. Coil spring 70 urges latch pin 63 in a downward direction as viewed in FIGS. 16 and 17 so that the latch pin assumes the latching position as shown in FIG. 17. Latch pin 63 may be manually raised upward by means of a handle 68 so as to assume the unlatched position wherein the latched pin is clear of a slot 62*a* in a lower portion of mounting bracket 62. Latch pin 63 may be maintained in the retracted, unlatched position by engaging a notch 63*a* in a lateral surface of the latch pin with an inner portion of the top guide plate 64 defining the aperture therein as in the previously described embodiment.

Slot 62*a* within mounting bracket 62 is adapted to receive a mounting pin 76 attached to an implement, such as the previously described bucket; for attaching the bucket to the arms of an end loader by means of the inventive quick attachment arrangement 60. A back stop 66 in the form of a 90° bent section of steel is attached to a lateral surface of mounting bracket 62 adjacent the inner end of slot 62*a* in the bracket. Back stop 66 engages a lateral portion of a mounting pin 76 attached to an implement (not shown for simplicity) inserted in slot 62*a* for maintaining the mounting pin securely in position in the slot of mounting bracket 62. The lower end of latch pin 63 includes first and second beveled portions 63*b* and 63*c*. An upper portion of mounting pin 76 includes a beveled corner 76*a* which is adapted for engaging the latch pin's shorter first beveled end portion 63*b* when inserting mounting pin 76 into slot 62*a*. The engagement of the mounting pin's beveled corner 76*a* with the latch pin's shorter first beveled end portion 63*a* facilitates rightward movement of mounting pin 76 and upward displacement of latch pin 63 for connecting the mounting pin to mounting bracket 62. Engagement of the rounded upper corner 76*b* of mounting pin 76 with the longer second beveled end portion 63*b* of mounting pin 63 facilitates leftward displacement of the mounting pin and upward movement of the latch pin 76 for disconnecting the mounting pin from mounting bracket 62.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The present invention is thus intended to provide a quick attachment arrangement between an end loader and virtually any type of load bearing or work performing implement with which end loaders operate. The matter set forth in the foregoing description and accompanying drawings is offered by way of illustration only and not as a limitation. The actual scope of the invention is intended to be defined in the following claims when viewed in their proper perspective based on the prior art.

I claim:

1. Apparatus for attaching an implement having upper and lower mounting pins to a movable arm of an end loader, said apparatus comprising:

a bracket pivotally coupleable to the movable arm;

an upper support member on said bracket adapted to engage and retain the upper mounting pin of the implement;

a lower slot in said bracket adapted to receive the lower mounting pin of the implement;

first and second apertured members disposed on said bracket;

a latch pin disposed in the apertures of said first and second apertured members and movable between a first unlatched position, wherein said latch pin is substantially clear of said lower slot and the lower mounting pin may be removed from said lower slot, and a second latched position, wherein said latch pin is disposed across said lower slot and the lower mounting pin is connected to said bracket for attaching the implement to the end loader arm;

a biasing member coupled to said latch pin for urging said latch pin to said second latched position; and a catch portion of said latch pin for engaging said first apertured member and maintaining said latch pin in the first unlatched position to allow the lower mounting pin to be removed from the lower slot as said lower mounting pin engages and pivotally displaces said latch pin in a first direction for maintaining the latch pin's catch portion in engagement with said first apertured member, and wherein a second lower mounting pin attached to a second implement inserted in the lower slot engages and pivotally displaces said latch pin in a second opposed direction for removing the latch pin's catch portion from engagement with said first apertured member and allowing said latch pin to move to the second latched position by means of said biasing member in attaching the second implement to the end loader.

2. The apparatus of claim 1 wherein said biasing member comprises a coil spring disposed about said latch pin.

3. The apparatus of claim 2 further comprising a cross member inserted through and extending outward from said latch pin, wherein said coil spring is disposed between and engages said first apertured member and said cross member for urging said latch pin to said second latched position.

4. The apparatus of claim 3 wherein said cross member comprises a roll pin.

5. The apparatus of claim 1 wherein said first apertured member is a first generally flat plate having a first aperture therein and wherein said latch pin is disposed in and extends through said first aperture.

6. The apparatus of claim 5 wherein said second apertured member is a second generally flat plate having a second aperture therein and wherein said latch pin is disposed in and extends through said second aperture.

7. The apparatus of claim 6 wherein said second apertured plate is disposed intermediate said first apertured plate and the lower slot in said bracket.

8. The apparatus of claim 7 wherein said latch pin is displaced about a first pivot point of contact between said latch pin and said second apertured member when the second lower mounting pin engages and displaces said latch pin in said first direction.

9. The apparatus of claim 8 wherein said first pivot point of contact is between said latch pin and an inner portion of said second apertured member defining the second aperture therein.

10. The apparatus of claim 9 wherein said latch pin is displaced about a second pivot point of contact between said latch pin and said second apertured member when the second lower mounting pin engages and displaces said latch pin in said second opposed direction.

11. The apparatus of claim 10 wherein said second pivot point of contact is between said latch pin and an inner portion of said second apertured member defining the second aperture therein.

12. The apparatus of claim 11 wherein said first and second pivot points are disposed on opposed portions of the second aperture in said second apertured member.

13. The apparatus of claim 1 further comprising a handle connected to said latch pin for manually moving said latch between said latched and unlatched positions.

14. The apparatus of claim 1 wherein said latch pin includes an angled distal end portion adapted for engagement by the implement's lower mounting pin when said lower mounting pin is inserted in the bracket's lower slot and said latch pin is in said second latched position, and wherein said latch pin is urged to the unlatched position by the lower mounting pin.

15. The apparatus of claim 1 wherein said upper support member comprises a generally linear, elongated U-shaped support groove.

16. The apparatus of claim 1 wherein said latch pin is disposed between and aligned with said upper support member and said lower slot.

17. The apparatus of claim 1 wherein said latch pin is cylindrical in shape and said catch portion is a recessed notch in a lateral surface of said latch pin adapted to receive and engage an inner portion of said first apertured member defining the first aperture therein.

18. The apparatus of claim 17 where said latch pin is aligned generally vertically and said upper support member and said lower slot are parallel and aligned generally horizontally.

19. The apparatus of claim 1 wherein said end loader includes a hydraulic cylinder and said bracket is pivotally coupleable to said hydraulic cylinder for raising and lowering the implement.

20. The apparatus of claim 19 further comprising first and second coupling pins pivotally connectable to said bracket and further connectable to said hydraulic cylinder and to said movable arm, respectively.

21. Apparatus for attaching an implement having upper and lower mounting pins to a movable arm of a vehicle, said apparatus comprising:

a bracket pivotally coupleable to the movable arm;

upper and lower slots in said bracket respectively adapted to engage and retain the upper and lower mounting pins;

first and second apertured members disposed on said bracket;

a latch pin having an angled distal end portion and disposed in the apertures of said first and second apertured members and movable between a first unlatched position, wherein said latch pin is clear of said lower slot allowing the lower mounting pin to be removed from said lower slot, and a second latched position, wherein said latch pin is disposed across said lower slot and the lower mounting pin is connected to said bracket for attaching the implement to the end loader arm;

a biasing member coupled to said latch pin for urging said latch pin to said second latched position; and a catch portion of said latch pin for engaging said first apertured member and maintaining said latch pin in the first unlatched position to allow the lower mounting pin to be inserted in and removed from the lower slot, wherein the lower mounting pin engages the end of said latch pin when inserted in the lower slot with said latch pin in the first unlatched position for pivotally displacing said latch pin and removing the latch pin's catch portion from engagement with said first apertured member and allowing said latch pin to move to the second latched position under the influence of said biasing member for attaching the implement to the end loader, and wherein the lower mounting pin engages the angled distal end portion of said latch pin when inserted in the lower slot and said latch pin is in the second latched position for urging said latch pin to the first unlatched position and allowing the lower mounting pin to be inserted in the lower slot whereupon the lower mounting pin pivotally displaces said latch pin so as to disengage the latch pin's catch portion from said first aperture member allowing said latch pin to assume the second latched position in attaching the implement to the end loader.

22. The apparatus of claim 21 wherein said biasing member comprises a coil spring disposed about said latch pin.

23. The apparatus of claim 22 further comprising a cross member inserted through and extending outward from said latch pin, wherein said coil spring is disposed between and engages said first apertured member and said cross member for urging said latch pin to said second latched position.

24. The apparatus of claim 23 wherein said cross member comprises a roll pin.

25. The apparatus of claim 21 wherein said first apertured member is a first generally flat plate having a first aperture therein and wherein said latch pin is disposed in and extends through said first aperture.

26. The apparatus of claim 25 wherein said second apertured member is a second generally flat plate having a second aperture therein and wherein said latch pin is disposed in and extends through said second aperture.

27. The apparatus of claim 26 wherein said second apertured plate is disposed intermediate said first apertured plate and the lower slot in said bracket.

28. The apparatus of claim 27 wherein said latch pin is displaced about a first pivot point of contact between said latch pin and said second apertured member when the second lower mounting pin engages and displaces said latch pin in said first direction.

29. The apparatus of claim 28 wherein said first pivot point of contact is between said latch pin and an inner portion of said second apertured member defining the second aperture therein.

30. The apparatus of claim 29 wherein said latch pin is displaced about a second pivot point of contact between said latch pin and said second apertured member when the second lower mounting pin engages and displaces said latch pin in said second opposed direction.

31. The apparatus of claim 30 wherein said second pivot point of contact is between said latch pin and an inner portion of said second apertured member defining the second aperture therein.

32. The apparatus of claim 31 wherein said first and second pivot points are disposed on opposed portions of the second aperture in said second apertured member.

33. The apparatus of claim 21 further comprising a handle connected to said latch pin for manually moving said latch between said latched and unlatched positions.

34. The apparatus of claim 21 wherein said latch pin includes an angled distal end portion adapted for engagement by the implement's lower mounting pin when said lower mounting pin is inserted in the bracket's lower slot and said latch pin is in said second latched position, and wherein said latch pin is urged to the unlatched position by the lower mounting pin.

35. The apparatus of claim 21 wherein said upper support member comprises a generally linear, elongated U-shaped support groove.

36. The apparatus of claim 21 wherein said latch pin is disposed between and aligned with said upper support member and said lower slot.

37. The apparatus of claim 21 wherein said latch pin is cylindrical in shape and said catch portion is a recessed notch in a lateral surface of said latch pin adapted to receive and engage an inner portion of said first apertured member defining the first aperture therein.

38. The apparatus of claim 37 where said latch pin is aligned generally vertically and said upper support member and said lower slot are parallel and aligned generally horizontally.

39. The apparatus of claim 21 wherein said end loader includes a hydraulic cylinder and said bracket is pivotally coupled to said movable arm and to said hydraulic cylinder for raising and lowering the implement.

40. The apparatus of claim 39 further comprising first and second coupling pins pivotally connecting said bracket to said hydraulic cylinder and to said movable arm, respectively.

41. Apparatus for attaching an implement having upper and lower mounting pins to a movable arm of an end loader, said apparatus comprising:

a bracket coupleable to the movable arm;

an upper support member on said bracket adapted to engage and retain an upper mounting pin of a first implement;

a lower slot in said bracket adapted to receive a lower mounting pin of said first implement;

a latch pin attached to said bracket and movable between a first unlatched position, wherein said latch pin is substantially clear of said lower slot and the lower mounting pin may be removed from said lower slot, and a second latched position, wherein said latch pin is disposed across said lower slot and the lower mounting pin is connected to said bracket for attaching the implement to the end loader arm;

a biasing member coupled to said latch pin for urging said latch pin to said second latched position; and a catch portion of said latch pin for engaging said bracket and maintaining said latch pin in the first unlatched position to allow the lower mounting pin to be removed from the lower slot as said lower mounting pin engages and pivotally displaces said latch pin in a first direction for maintaining the latch pin's catch portion in engagement with said bracket, and wherein a lower mounting pin attached to a second implement inserted in the lower slot engages and pivotally displaces said latch pin in a second opposed direction for removing the latch pin's catch portion from engagement with said bracket and allowing said latch pin to move to the second latched position under the influence of said biasing member in attaching the second implement to the end loader.

42. Apparatus for attaching an implement having upper and lower mounting pins to a movable arm of a vehicle, said apparatus comprising:

a bracket coupleable to the movable arm;

upper and lower slots in said bracket respectively adapted to engage and retain the upper and lower mounting pins;

a latch pin having an angled distal end portion and attached to said bracket and movable between a first unlatched position, wherein said latch pin is clear of said lower slot allowing the lower mounting pin to be removed from said lower slot, and a second latched position, wherein said latch pin is disposed across said lower slot and the lower mounting pin is connected to said bracket for attaching the implement to the end loader arm;

a biasing member coupled to said latch pin for urging said latch pin to said second latched position; and a catch portion of said latch pin for engaging said bracket and maintaining said latch pin in the first unlatched position to allow the lower mounting pin to be inserted in and removed from the lower slot, wherein the lower mounting pin engages the end of said latch pin when inserted in the lower slot with said latch pin in the first unlatched position for pivotally displacing said latch pin and removing the latch pin's catch portion from engagement with said bracket and allowing said latch pin to move to the second latched position under the influence of said biasing member for attaching the implement to the end loader, and wherein the lower mounting pin engages the angled distal end portion of said latch pin when inserted in the lower slot with said latch pin in the second latched position for urging said latch pin to the first unlatched position and allowing the lower mounting pin to be inserted in the lower slot whereupon the lower mounting pin pivotally displaces said latch pin so as to disengage the latch pin's catch portion from said bracket allowing said latch pin to assume the second latched position in attaching the implement to the end loader.

* * * * *